US006175103B1

(12) United States Patent
Lam et al.

(10) Patent No.: US 6,175,103 B1
(45) Date of Patent: Jan. 16, 2001

(54) AUTOMATED HEAT TREATMENT FURNACE

(75) Inventors: Raymond K. F. Lam, Park Ridge, NJ (US); Edward N. Switzer, Cornwall; Tony Sica, Mt. Vernon, both of NY (US)

(73) Assignee: Praxair S.T. Technology, Inc., Danbury, CT (US)

( * ) Notice: Under 35 U.S.C. 154(b), the term of this patent shall be extended for 0 days.

(21) Appl. No.: 09/151,923

(22) Filed: Sep. 11, 1998

(51) Int. Cl.[7] ..... H05B 1/02

(52) U.S. Cl. ..... 219/506; 219/486; 219/214; 219/494

(58) Field of Search ..... 219/506, 400, 219/407, 409, 399, 530, 486, 243, 214, 494; 165/64; 266/89

(56) References Cited

U.S. PATENT DOCUMENTS 5,102,492 * 4/1992 Bregolin et al. ..... 156/583.6
5,126,945 * 6/1992 Jenista et al. ..... 364/468.05
5,407,000 * 4/1995 Mercer, II et al. ..... 164/457
5,407,119 * 4/1995 Churchill et al. ..... 228/124.5
5,435,378 * 7/1995 Heine et al. ..... 165/64
5,517,593 * 5/1996 Nenniger et al. ..... 392/301
5,643,528 * 7/1997 Gras ..... 266/88
5,708,253 * 1/1998 Bloch et al. ..... 219/130.01
5,786,568 * 7/1998 McKinney ..... 219/400
5,854,749 * 12/1998 Kellams et al. ..... 364/472.02
6,011,243 * 1/2000 Arnold et al. ..... 219/506

* cited by examiner

*Primary Examiner*—Teresa Walberg
*Assistant Examiner*—Jeffrey Pwu
(74) *Attorney, Agent, or Firm*—Blake T. Biederman

(57) ABSTRACT

An automated heat treatment controller consistently controls heat treating a metallic target in a furnace according to a heat treatment recipe including a cycle temperature and a cycle exposure time. The automated heat treatment controller includes an operator interface for prompting an operator to load or remove a heat treated target. The controller further provides for commanding furnace door locks and for monitoring system performance. An automated heat treatment furnace method includes the steps of pre-heating the furnace, prompting the user to load the material, reheating the furnace to heat treatment parameters, controlling the exposure time and temperature, and prompting the removal of the material.

7 Claims, 5 Drawing Sheets

AUTOMATED HEAT TREATMENT FURNACE

FIELD OF THE INVENTION

The present invention relates to the control of metallic material heat treatment, particularly of sputtering target heat treatment in electric furnaces.

BACKGROUND OF THE INVENTION

Grieve ovens, also referred to as furnaces, are utilized to process materials at elevated temperatures for homogenization, recrystallization, die pressing, annealing, stress relief, and hot rolling. These heat treatment processes provide methods of controlling grain structures, grain sizes, distributions of alloying elements, and grain orientations. Desirable sizes and shapes are obtained by rolling after the heat treatments. Manual operations are employed to control all heat treatment processes. Operators set the cycle temperature at the setpoint, or the "aim temperature," of the temperature controller 30. When the oven is heated to a temperature close to the cycle temperature, materials are loaded in the oven for heat treatment. Heat treatment time begins to count once the oven door is closed.

This manual process has many disadvantages, which leads to improperly heat treated materials and thus waste or defective products.

Exposure time to the cycle temperature might not be consistently controlled. This can be due to the operator failing to initiate the timer properly or to remove the material promptly when cycle time has expired. Since recipe parameters are manually referenced, the operator may reference the cycle time incorrectly.

Variations in temperature control occur since process control is subject to the discretion of individual operator. Mistakes happen for many reasons, such as when the operator incorrectly references the appropriate heat treatment recipe. A different operator assumes control of an ongoing treatment at shift change and may make a mistake as to the temperature parameters. The operator may take more or less than time than average in loading the material, allowing the starting temperature to vary from the expected temperature due to the door being open. Undetected degraded hardware could cause loss of control over the cycle temperature.

This lack of real-time monitoring creates additional disadvantages of the manual system. The lack of an automatic alert wastes time causing an economic loss. Relying on an individual operator to monitor the process closely causes increased labor expense in staffing and training. Moreover, the mundane nature of such manual monitoring makes timely detection difficult.

Improvements using statistical process control are difficult to accomplish since historical temperature data is not automatically gathered. As is the real-time data, the historical data is subject to the errors during manual collection. Moreover, errors are introduced when inputting the manually-collected data for analyzing for statistical process control (SPC) purposes. These additional steps make the time delay and frequency in such calculations problematic.

Therefore, a significant need continues to exist for a manner of controlling heat treatment furnaces to reduce amount of improperly processed materials and to reduce the labor expense.

SUMMARY OF THE INVENTION

The invention addresses these and other problems associated with the prior art by providing an apparatus and method that controls both the heat treatment cycle exposure time and cycle temperature for a heat treatment furnace, especially for the heat treatment of metallic targets used in semiconductor manufacturing. Achieving a consistent control of heat treatment cycle time and temperature for a variety of targets and oven types in the manner disclosed herein results in a consistent product with less required labor.

Consistent with one aspect of the invention, an automated heat treatment controller, operably coupled to the furnace and including an operator interface, maintains the cycle temperature by controlling a setpoint temperature of the furnace, and manages the cycle exposure time during heat treatment by prompting an operator via the operator interface to remove a heat treated target after the cycle exposure time has elapsed.

Consistent with another aspect of the invention, an automated heat treatment method is provided which includes accessing a heat treatment recipe including a cycle temperature and a cycle exposure temperature; executing the cycle exposure time while maintaining the cycle temperature; and prompting the operator to unload the target after the cycle exposure time has elapsed.

These aspects of the invention, as well as others discussed below, allow the automated heat treatment furnace to mitigate human error and variances in furnace performance that would otherwise result in defectively heat treated targets.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

The invention relates to producing heat treated targets for applications like sputtering with increased consistency by controlling heat treatment furnaces used to treat such targets. Achieving this advancement in economy and quality is accomplished by a heat treatment automated system for interfacing with the operator and for controlling the process time and temperature.

Figure 1:
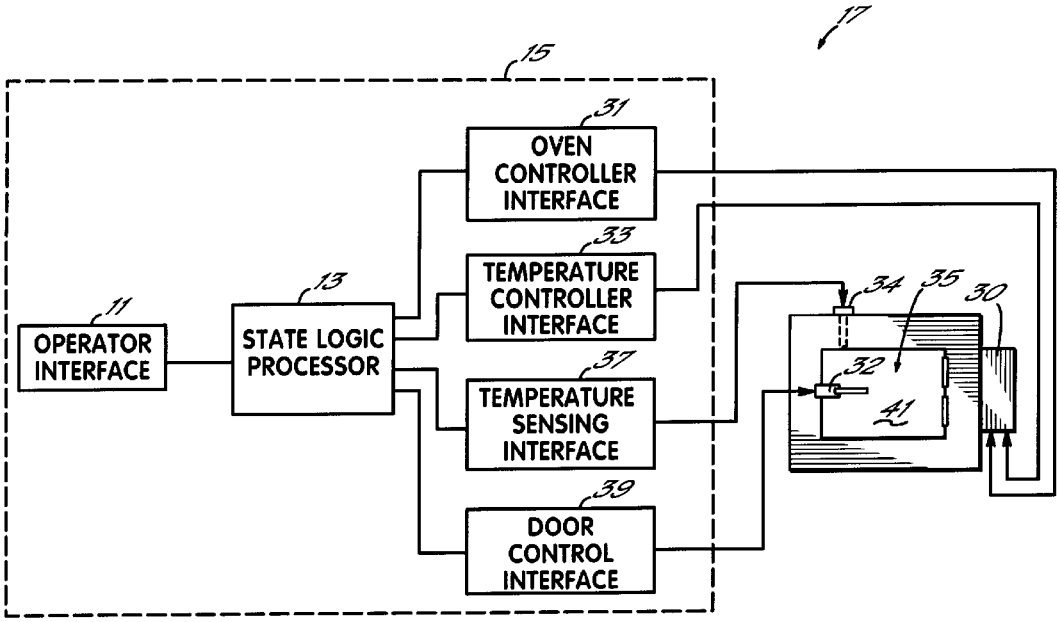
FIG. 1 is a functional block diagram of an automated heat treatment furnace including an automated heat treatment controller consistent with the invention.

Referring to FIG. 1, the automated heat treatment furnace 17 is comprised of an automated heat treatment controller 15 operably coupled with a first furnace 41 having a temperature sensor 34, a heat source 30, a door 35, and optionally a remotely controllable door lock 32.

The automated heat treatment controller 15 is further comprised of a state logic processor 13 that is electrically connected to and programmed to control an operator interface 11 and three, and optionally four, interfaces to the first furnace 41. The first of the four furnace interfaces, an oven controller interface 31, enables power to the heat source 30 of the first furnace 41. The second furnace interface, a temperature controller interface 33, provides a setpoint temperature setting to the heat source 30 of the first furnace 41. The third furnace interface, a temperature sensing interface 37, monitors the interior temperature of the first furnace 41 by being operably coupled with a temperature sensor 34. Optionally, a fourth furnace interface, a door control 39, is provide if the first furnace 41 has remotely controllable door lock 32. In which case, the door control interface 39 interfaces with this door lock 32.

Figure 2:
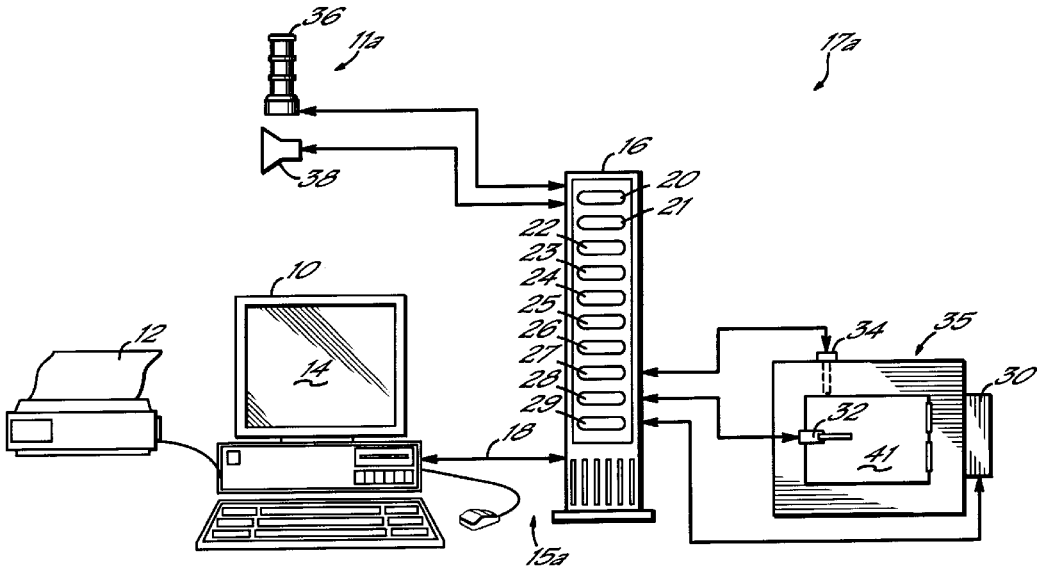
FIG. 2 is a block diagram of a first augmented automated heat treatment furnace consistent with the invention.

One specific implementation of the apparatus of FIG. 1 is shown in FIG. 2 as a first augmented automated heat treatment furnace 17*a*. The automated heat treatment controller 15*a* is realized in this implementation by the augmented graphical operator interface 11*a*. The programmable logic controller 16 accomplishes most of the implementation of the automated heat treatment controller 15. Its central processing unit module 21 performs the state logic processor 13 function, communicating with and controlling the other interfaces. The augmented graphical operator interface 11*a* performing the operator interface 11 function includes a general purpose computer 10 having a display 14. A wide variety of operator interfaces may be used consistent with the invention, including but not limited to text interfaces, graphical user interfaces, lights, control panels, audible interfaces, and using various user input mechanisms such as keyboards, control panels, mice and other pointing devices, touch screens, etc.

The augmented graphical operator interface 11*a* is augmented in that it has other prompting devices. First, a signal light 36 provides a flashing or steady lights in three colors as a prompt to the operator. In general, a flashing colored light prompt is to prompt the operator to take an action with respect to the furnace (e.g., opening or closing the door, loading or unloading the material, etc.). A green light indicates that the process is operating normally. A yellow light indicates that the furnace is not at the desired temperature yet. A red light indicates system malfunction.

Second, a signal horn 38 is an additional operator prompt, especially useful when operator action is required. Third, a printer 12 attached to the general purpose computer 10 allows for screen printing information from the operator interface 11.

Figure 3:
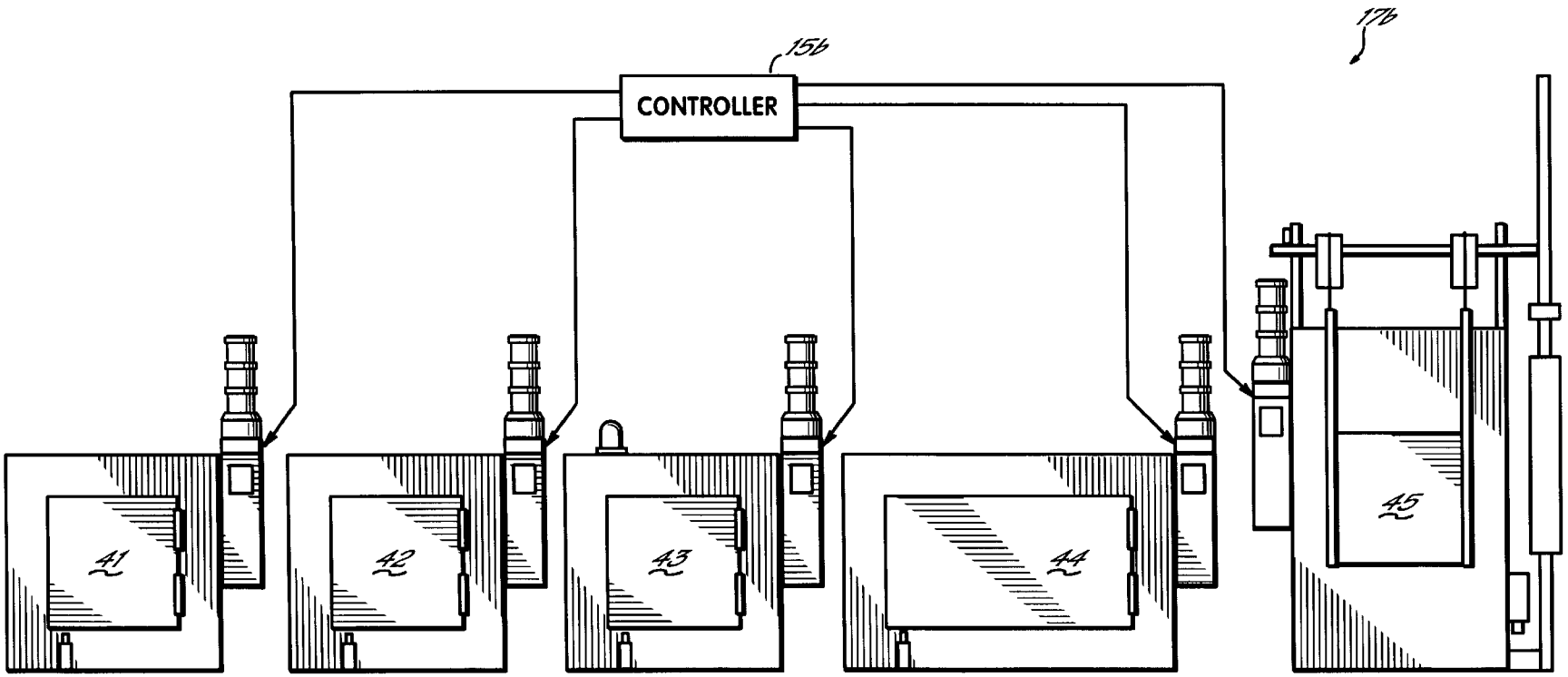
FIG. 3 is a depiction of a second augmented automated heat treatment furnace consistent with the invention, referred to as the illustrative embodiment, in which the first automated heat treatment controller shown in FIG. 2 is shown in simplified form.

Referring to FIG. 3, an illustrative embodiment consistent with the invention of an automated heat treatment furnace suite 17*b* is shown with five furnaces: the first furnace 41, a second furnace 42, a third furnace 43, a fourth furnace 44, and a fifth furnace 45. The multitasked automated heat treatment controller 15*a* is shown in simplified block form operably connected to the five furnaces 41–45.

In this illustrative embodiment, the multitasked automated heat treatment controller 15*b* is implemented in a fashion very similar to the automated heat treatment controller 15*a* depicted in FIG. 2. The detailed electrical connections between the programmable logic controller 16 and the various components of the furnaces 41–45 are described below.

In the illustrative embodiment, the heat source 30 of each furnace is available from Honeywell as a remote setpoint temperature controller model UDC2000, part number #DC200E-0-210-1000-00, although those skilled in the art would be familiar with many substitutes and equivalents. This heat source 30 accepts a setpoint temperature from the programmable logic controller 16.

Temperature sensor 34 is provided for the furnace. The illustrative embodiment has temperature sensing by means of a top thermocouple and a bottom thermocouple, although it should be appreciated that many methods of detecting temperature could be substituted.

The programmable logic controller 16 of FIG. 2 could be configured in many ways for various combinations and types of furnaces. The illustrative embodiment comprises a programmable logic controller 16 is primarily built with ten modules 20–29, as shown in FIG. 2. For each module, the specific function, commercially-available hardware, and pin-out connections for the illustrative embodiment are discussed below. The part numbers mentioned with each is that given by GE Fanuc Automation North America, Inc.

The first module is a power supply module 20 that powers the programmable logic controller 16. In the illustrative embodiment, the power supply module 20 is a GE Fanuc 30W power supply module, part number #IC693PWR321.

The second module is a CPU module 21 that performs the state logic processor 13 function. In the illustrative embodiment, the CPU module 21 is a GE Fanuc modular central processing unit (CPU) with state logic, part number #IC693CSE340.

The third module is a temperature controller module 22 that provides a setpoint temperature to the temperature controller 30. In the illustrative embodiment, the temperature controller module 22 is a GE Fanuc analog voltage input, 8/16 channel, 0–10 VDC module, part number #IC693ALG222. One suitable pin-out diagram for the temperature controller module 22 is shown in TABLE 1.

TABLE 1

| Pin | Description |
|---|---|
| | Temperature controller module (22) |
| 3 | First oven, temperature controller, positive lead |
| 4 | First oven, temperature controller, negative lead |
| 5 | Second oven, temperature controller, positive lead |
| 6 | Second oven, temperature controller, negative lead |
| 7 | Third oven, temperature controller, positive lead |
| 8 | Third oven, temperature controller, negative lead |
| 9 | Fourth oven, temperature controller, positive lead |
| 10 | Fourth oven, temperature controller, negative lead |
| 11 | Fifth oven, temperature controller, positive lead |
| 12 | Fifth oven, temperature controller, negative lead |

The fourth module is the door control module 23 that detects door and door lock position, using a GE Fanuc positive/negative input, 24 VDC, 16 points module, part number #IC693MDL645. One suitable pin-out diagram is shown as TABLE 2.

TABLE 2

| Pin | Description |
|---|---|
| | Door control module (23) |
| 1 | Constant 24 VDC |
| 2 | First oven, door extension switch, positive lead |
| 3 | First oven, door retraction switch, positive lead |
| 4 | Second oven, door extension switch, positive lead |
| 5 | Second oven, door retraction switch, positive lead |
| 7 | Third oven, door extension switch, positive lead |
| 8 | Third oven, door retraction switch, positive lead |
| 9 | Fourth oven, door extension switch, positive lead |
| 10 | Fourth oven, door retraction switch, positive lead |
| 11 | First oven, door switch |
| 12 | Fifth oven, microswitch at door closed position |
| 13 | Second oven, door switch |
| 14 | Fifth oven, footpedal extension switch |
| 15 | Fifth oven, footpedal retraction switch |
| 16 | Third oven, door switch |
| 17 | Fourth oven, door switch |

The fifth module is an oven controller module 24, providing power to the heat source 30 of the ovens 41–45, using a GE Fanuc analog current/voltage output, 8 channels, 4–20 mA module, part number IC693ALG392 (FIG. 2, item 24). One suitable pin-out diagram is shown as TABLE 3.

TABLE 3

| Pin | Description |
|---|---|
| | Oven controller module (24) |
| 1 | +24 VDC |
| 3 | First oven, oven controller |
| 5 | Second oven, oven controller |
| 7 | Third oven, oven controller |
| 9 | Fourth oven, oven controller |
| 11 | Fifth oven, oven controller |
| 19 | Constant 24 VDC |

A sixth module is referred to as a first signal light and horn module 25, controlling horn and light prompts, using a GE Fanuc, relay output, normally open, 2A, 16 points module, part number #IC693MDL940D. One suitable pin-out diagram is given in TABLE 4.

TABLE 4

| Pin | Description |
|---|---|
| | First signal light and horn module (25) |
| 1 | +24 VDC |
| 2 | red light/horn |
| 3 | First oven, green light |
| 4 | First oven, amber light |
| 5 | First oven, red light |
| 6 | +24 VDC |
| 7 | First oven, horn |
| 8 | Second oven, green light |
| 9 | Second oven, amber light |
| 10 | Second oven, red light |
| 11 | +24 VDC |
| 12 | Second oven, horn |
| 13 | Third oven, green light |
| 14 | Third oven, amber light |
| 15 | Third oven, red light |
| 16 | +24 VDC |
| 17 | Third oven horn |

A seventh module is referred to as a door cylinder relay module 26, controlling door lock actuation, using the same GE Fanuc module as the first signal light and horn module 25. One suitable pin-out diagram is shown in TABLE 5.

TABLE 5

| Pin | Description |
|---|---|
| | Door cylinder relay module (26) |
| 1 | Constant 24 VDC |
| 2 | First oven, cylinder extension valve |
| 3 | First oven, cylinder retraction valve |
| 4 | Second oven, cylinder extension valve |
| 5 | Second oven, cylinder retraction valve |
| 6 | Constant 24 VDC |
| 7 | Third oven, cylinder extension valve |
| 8 | Third oven, cylinder retraction valve |
| 9 | Fourth oven, cylinder extension valve |
| 10 | Fourth oven, cylinder retraction valve |
| 11 | Constant 24 VDC |
| 12 | Fifth oven, air cutoff solenoid valve |
| 13 | Fifth oven, foot pedal cylinder extension valve |
| 14 | Fifth oven, foot pedal |
| 16 | Constant 24 VDC |

An eighth module referred to as a second signal light and horn module 27, controlling the additional horn and light prompts on additional furnaces, using the same GE Fanuc module as the previous two modules. One suitable pin-out diagram is shown as TABLE 6.

TABLE 6

| Pin | Description |
|---|---|
| | Second signal light and horn module (27) |
| 1 | +24 VDC |
| 2 | Fourth oven, green light |
| 3 | Fourth oven, amber light |
| 4 | Fourth oven, red light |
| 5 | Fourth oven, horn |
| 6 | +24 VDC |
| 7 | Fifth oven, green light |
| 8 | Fifth oven, amber light |
| 9 | Fifth oven, red light |
| 10 | Fifth oven, horn |
| 11 | +24 VDC |
| 16 | +24 VDC |

The ninth module is referred to as a first thermocouple input module 28, monitoring the temperature sensing thermocouples, and using Horner Electric thermocouple, 8 channel module, part number #HC693THM884. One suitable pin-out diagram is given in TABLE 7.

TABLE 7

| Pin | Description |
|---|---|
| | First thermocouple input module (28) |
| 3 | First oven, top thermocouple, negative lead |
| 4 | Third oven, top thermocouple, negative lead |
| 5 | First oven, top thermocouple, positive lead |
| 6 | Third oven, top thermocouple, positive lead |
| 7 | First oven, bottom thermocouple, negative lead |
| 8 | Third oven, bottom thermocouple, negative lead |
| 9 | First oven, bottom thermocouple, positive lead |
| 10 | Third oven, bottom thermocouple, positive lead |
| 11 | Second oven, top thermocouple, negative lead |
| 12 | Fourth oven, top thermocouple, negative lead |
| 13 | Second oven, top thermocouple, positive lead |
| 14 | Fourth oven, top thermocouple, positive lead |
| 15 | Second oven, bottom thermocouple, negative lead |
| 16 | Fourth oven, bottom thermocouple, negative lead |
| 17 | Second oven, bottom thermocouple, positive lead |

TABLE 7-continued

| Pin | Description |
|---|---|
| 18 | Fourth oven, bottom thermocouple, positive lead |
| 19 | cable shield of first & second ovens, top & bottom thermocouples |
| 20 | cable shield of third & fourth ovens, top & bottom thermocouples |

The tenth module is referred to as a second thermocouple input module 29, monitoring additional temperature sensing thermocouples, using the same Horner module as the previous module. One suitable pin-out diagram is given in TABLE 8.

TABLE 8

| Pin | Description |
|---|---|
| | Second thermocouple input module (29) |
| 3 | Fifth oven, top thermocouple, negative lead |
| 4 | UNUSED - top thermocouple, negative lead |
| 5 | Fifth oven, top thermocouple, positive lead |
| 6 | UNUSED - top thermocouple, positive lead |
| 7 | Fifth oven, bottom thermocouple, negative lead |
| 8 | UNUSED - bottom thermocouple, negative lead |
| 9 | Fifth oven, bottom thermocouple, positive lead |
| 10 | UNUSED - bottom thermocouple, positive lead |
| 11 | UNUSED - top thermocouple, negative lead |
| 12 | UNUSED - top thermocouple, negative lead |
| 13 | UNUSED - top thermocouple, positive lead |
| 14 | UNUSED - top thermocouple, positive lead |
| 15 | UNUSED - bottom thermocouple, negative lead |
| 16 | UNUSED - bottom thermocouple, negative lead |
| 17 | UNUSED - bottom thermocouple, positive lead |
| 18 | UNUSED - bottom thermocouple, positive lead |
| 19 | cable shield of fifth oven, top & bottom thermocouples |
| 20 | UNUSED cable shield ground |

It is well understood by one with ordinary skill in the art how to electrically connect an automated heat treatment controller 15, such as a programmable logic controller 16, consistent with the above mentioned tables.

Returning to augmented graphical operator interface of FIG. 2, the operator makes selections using a number of methods, including the keyboard or the computer mouse of the general purpose computer 10.

In the illustrative embodiment, the operator interface is facilitated by commercial software by Wonderware Corporation called WONDERWARE, IN-TOUCH. This graphical operator interface includes a runtime system, statistical process control (SPC) module, recipe manager, and GE Fanuc Series 90 Protocol Dynamic Data Exchange (DDE) Server.

Operator interface can be accomplished through innumerable approaches. Some applications of the invention may be so specialized as to run the same material in a repetitious manner making operator interface minimal.

In the illustrative embodiment, however, the graphical operator interface increases the intuitive interpretation of system information with animated representations of elements, such as a stackable signal light 36 mounted on each furnace and the signal horn 38, as will become more apparent below.

Figure 4:
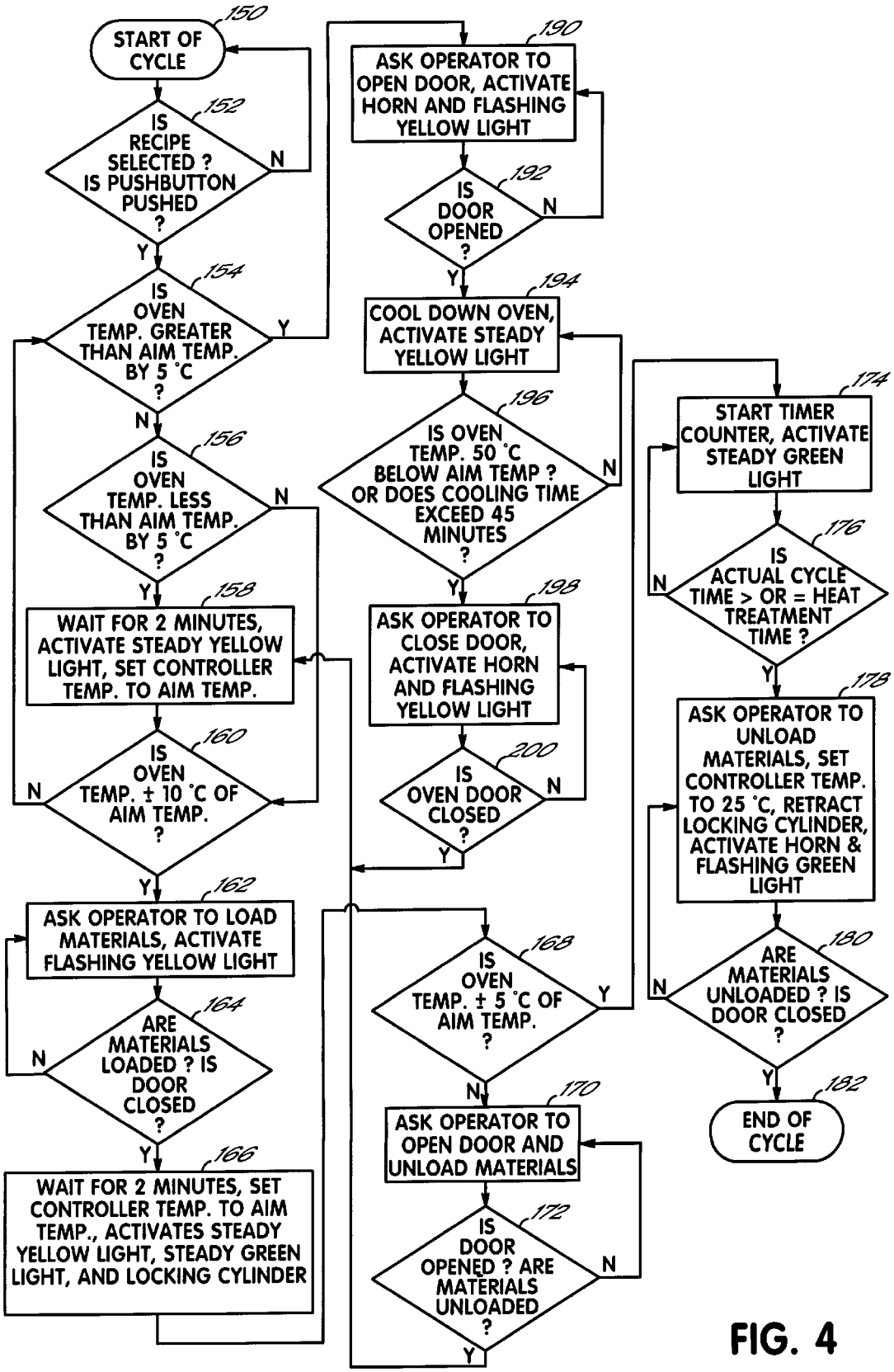
FIG. 4 is flow diagram of a heat treatment process consistent with the invention.

For the automated heat treatment furnace 17*a* of FIG. 2, a flow diagram is shown in FIG. 4 for a heat treatment method. In the illustrative embodiment a combination of the horn 38, signal light 36 and graphical operator interface on the computer display 14 are used to prompt the operator. It is to be understood that comparable results can be obtained by substituting other prompts in various combinations. In addition, it is implicitly understood that when the control status changes or prompt status changes, this information is shared with the graphical operator interface in the illustrative embodiment.

Referring to FIG. 4, the start of cycle block 150 is the initial state. The operator inputs a desired recipe of target temperature and exposure time for a specified furnace as required for block 152 via the graphical operator interface. In the illustrative embodiment, selectable recipes are accessible by the operator. Inputting a new recipe requires additional security passwords.

Once the recipe is selected and the cycle is started, the heat treatment automation system checks to see if the furnace is already above the desired target temperature, as shown in block 154. This is physically accomplished in the illustrative embodiment by the programmable logic controller 16 accessing the temperature measurement from the temperature sensors for that furnace. If the oven temperature is not greater than the target, or aim, temperature by 5° C., processing proceeds to block 156 to verify that the oven is not already near the aim temperature by testing whether the oven temperature is less than the aim temperature by 5° C. or more. If block 156 is satisfied by the temperature being too far from the aim temperature, then processing proceeds to block 158, described below. Else, processing skips to block 160, also described below.

Backing up to the alternate result for block 154, if the temperature is more than five degrees Celsius above the target temperature, then the method includes prompting the operator to open the door, as shown in block 190. In the illustrative embodiment this includes activating the horn, flashing the yellow light at the signal light 36, and providing similar information to the graphical operator interface to animate the status screens. If the door is not detected as being open in block 192 then this prompt to the operator to open the door is maintained by returning to block 190. If the door is detected as being open in block 192, then the process goes to the next block 194 setting the cool down oven status with corresponding steady yellow light.

Next is the block 196 for monitoring when the measured temperature is 50 degrees Celsius below the setpoint temperature, or else if forty-five minutes with the door open has elapsed. If neither has occurred, then the process returns to the block 194 repeating until one of the two conditions is satisfied. Once either the lowered temperature or time condition is satisfied, the process proceeds to block 198 to prompt the operator to close the door. In the illustrative embodiment, this is accomplished by sounding the horn 38, setting the signal light 36 to flashing yellow, and changing the animation of the corresponding screens on the graphical operator interface.

Processing alternates between the next block 200 testing for the door being closed and returning to prompting the operator to close the door at block 198 until the door is detected closed, in which case, the process proceeds to block 158, in which the temperature controller 30 is set to the setpoint temperature, a waiting period of two minutes is used to stabilize the temperature is initiated, and the signal light 36 is set to a steady yellow.

After the two minutes, processing proceeds to block 160 to see if the measured temperature is within ten degrees Celsius of the setpoint temperature. If it is not, processing proceeds back to the initial temperature check of block 154 and processing proceeds from there as described above. If the temperature has stabilized within the ten degrees Celsius, then processing proceeds to block 162 where the operator is prompted to load materials by flashing the yellow light. Going to block 164, the door status is monitored until the material is loaded and the door is shut. Then processing goes to block 166 to return the furnace to its setpoint temperature parameters by initiating a two minute clock, setting the temperature controller 30 temperature to the setpoint temperature, and activating a steady yellow and steady green light on the signal light 36 and locking the furnace door with the pneumatic lock 32. After the two minutes have elapsed, processing goes to block 168 to check to see if the measured temperature is within five degrees Celsius of the setpoint temperature. If not, block 170 prompts the operator to open the door and unload the materials. Block 172 next monitors until the door is opened and the material is unloaded. If block 172 is not satisfied by having the door opened and material unloaded, then processing returns block 170 to maintain the prompt the operator. If block 172 is satisfied, then processing returns to block 158 to preheat the furnace again without material loaded, with processing thereafter as described above.

If block 168 had found the temperature to be within five degrees Celsius, then processing goes to block 174 where the timer counter is started and the signal light switched to steady green to denote that the main heat treatment cycle is underway. The system stays in this state until block 176 finds that the actual cycle time meets or exceeds the heat treatment time specified in the selected recipe. When this condition is met, block 178 prompts the operator to unload the materials, sets the controller temperature to 25 degrees Celsius, unlocks the door lock 32, sounds the horn 38, and sets the signal light 36 to flashing green. The system stays in this state until the block 180 determines that the materials are unloaded and the door is closed again. When this is accomplished, then block 182 sets status to end of cycle.

It should be appreciated that the logic described in FIG. 4 can be operated independently for a number of furnaces and recipes. In the illustrative embodiment, this is accomplished by having the programmable logic control 16 provide the control and monitoring for multiple furnaces as shown in FIG. 3. The graphical operator interface for all is operated on the same general purpose computer 10.

In the illustrative embodiment of the invention, the detailed logic used in the programmable logic controller 16 is shown for each function, facilitated by the commercially-available English Control Language and Programming System (ECLiPS), a high level programming language. Specifically, referring to TABLE 9, the Start Cycle Status is the implementation of the start of cycle 150 and recipe selection 152 mentioned in the flow diagram of FIG. 3.

TABLE 9

| STEP | TASK/STATE | CONDITION | OPERATION | ACTUATOR |
|---|---|---|---|---|
| | | START CYCLE STATUS | | |
| 1A | POWER UP | start push-button is pressed. | set cycle start to on. | |
| | | cycle is completed. | set cycle done to off. | |
| | | recipe is chosen (Recipe OK = 1). | | |

The heat treat cycle logic of TABLES 10A–D is the implementation of the remainder of the flow diagram of FIG. 4.

TABLE 10A

| STEP | TASK/STATE | CONDITION | OPERATION | ACTUATOR |
|---|---|---|---|---|
| | | HEAT TREAT CYCLE | | |
| 2A | POWER UP | if cycle start is on. | go to PREPARATION. | |
| 3A | PREPARATION | | down load cycle temp & cycle time.<br>reset all variables to zero. | |
| | | if (T,controller − T,cycle) ≧ 5° C. | go to PRE COOL DOWN (step 4A). | |
| | | if (T,controller − T,cycle) < 5° C. | go to TEMP STABLE 1A [step 7A]. | |
| 4A | PRE COOL DOWN | | message to ask operator to open door.<br>set temp. setpoint to 25° C.<br>wait for operator to respond. | horn is on. flashing yellow light is on. |
| | | if operator opens door. | go to COOL DOWN WAIT [step 5A]. | |
| 5A | COOL DOWN WAIT | | message to wait for temperature.<br>start time counter Cool-Time1. | steady yellow light is on. |
| | | if T,controller ≦ 50° C. and Cool-Time1 ≧ 45 min. | go to PRE DOOR CLOSE [step 6A]. | |
| 6A | PRE DOOR CLOSE | | message to ask operator to close door. | horn is on. flashing yellow light is on. |
| | | if operator closes door. | go to TEMP STABLE 1A [step 7A]. | |
| 7A | TEMP STABLE 1A | | message to wait for temperature.<br>wait for 2 minutes.<br>go to TEMP STABLE 1B [step 8A]. | steady yellow light is on. |

TABLE 10B

| STEP | TASK/STATE | CONDITION | OPERATION | ACTUATOR |
|---|---|---|---|---|
| | | HEAT TREAT CYCLE (continued) | | |
| 8A | TEMP STABLE 1B | | message to wait for temperature.<br>set temp. setpoint to cycle temperature.<br>set T,upper = T,cycle + 10° C. | steady yellow light is on. |
| | | if (T,controller − T,cycle) > 10° C. | set T,lower = T,cycle − 10° C. | |
| | | if T,lower ≦ T,controller ≦ T,upper. | go to PRE COOL DOWN [step 4A]. | |
| | | | go to ASK MATERIALS IN [step 9A]. | |
| 9A | ASK MATERIALS IN | | message to ask operator to load materials. | horn is on. flashing yellow light is on. |
| | | if operator opens door. | set temp. setpoint to 25° C. | |
| | | | go to WAIT MATERIALS IN [step 10A] | |
| 10A | WAIT MATERIALS IN | | (wait for operator to load materials). | steady yellow light is on. |
| | | if operator closes door. | go to TEMP STABLE 2A [step 11A]. | |
| 11A | TEMP STABLE 2A | | message to wait for temperature.<br>wait for 2 minutes. | steady yellow light is on.<br>steady green light is on. |
| | | | got to TEMP STABLE 2B [step 12A]. | cylinder is extended to lock door. |

TABLE 10C

| STEP | TASK/STATE | CONDITION | OPERATION | ACTUATOR |
|---|---|---|---|---|
| | | HEAT TREAT CYCLE (continued) | | |
| 12A | TEMP STABLE 2B | | message to wait for temperature.<br>set temp. setpoint to cycle temperature.<br>set T,upper = T,cycle + 5° C. | steady yellow light is on.<br>steady green light is on.<br>cylinder is extended to lock door. |
| | | if (T,controller − T,cycle > 5° C.<br>if T,lower ≦ T,controller ≦ T,upper. | set T,lower = T,cycle − 5° C.<br>go to PRE COOL DOWN 2 [step 13A]. | |
| | | | go to TIMER ON [15A]. | |
| 13A | PRE COOL DOWN 2 | | message to ask operator to open door.<br>message to ask operator to unload materials. | cylinder is retracted to unlock door.<br>horn is on. |
| | | if operator opens door. | set temp. setpoint to 25° C.<br>go to COOL DOWN WAIT 2 [step 14A]. | flashing yellow light is on. |
| 14A | COOL DOWN WAIT 2 | | message to wait for temperature.<br>start time counter Cool-Time 2. | steady yellow light is on. |
| | | if T,controller ≦ 50° C. and Cool-Time2 ≧ 30 min. | go back to PRE DOOR CLOSE [step 6A]. | |
| 15A | TIMER ON | | start time counter Cycle-Time.<br>message to indicate cycle timer is on. | steady green light is on. |
| | | if Cycle-Time ≧ cycle time. | go to CYCLE STOP [step 16A]. | |
| 16A | CYCLE STOP | | message to indicate cycle is done.<br>message to ask operator to unload materials. | cylinder is retracted to unlock door.<br>horn is on. |
| | | if operator opens door. | set temp setpoint to 25° C.<br>go to WAIT MATERIAL OUT [step 17A]. | flashing green light is on. |

TABLE 10D

| STEP | TASK/STATE | CONDITION | OPERATION | ACTUATOR |
|---|---|---|---|---|
| | | HEAT TREAT CYCLE | | |
| 17A | WAIT MATERIAL OUT | | (operator is unloading materials). | steady green light is on. |
| | | if operator closes door. | go to CYCLE RESET [18A]. | |
| 18A | CYCLE RESET | | set temp. setpoint to 100° C.<br>set Recipe_OK = 0.<br>halt time counters.<br>return to POWER UP [step 1A]. | |

In addition, this detailed control logic of the illustrative embodiment provides additional features. First, a cycle abort is given in TABLE 11.

TABLE 11

| ABORT CYCLE STATUS | | | | |
|---|---|---|---|---|
| 1B | POWER UP | if cycle stop is activated. | go to CYCLE ABORT [step 2B]. | |
| 2B | CYCLE ABORT | | message to ask operator to unload materials. | cylinder is retracted to unlock door. |
| | | if operator opens door or faults are reset. | set temp. setpoint to 25° C. | horn is on. |
| | | | go to RESET [step 3B]. | red light is on. |
| 3B | RESET | | reset all messages.<br>return to POWER UP [step 1B]. | |

Second, door lock monitoring function in the form of a pneumatic cylinder check function is given in TABLE 12.

TABLE 12

| PNEUMATIC CYLINDER CHECK | | | | |
|---|---|---|---|---|
| 1C | POWER UP | if cylinder is commanded to extended. | go to CYN CLOSE WAIT [step 2C]. | |
| | | if cylinder is commanded to retracted. | go to CYN OPEN WAIT [step 3C]. | |
| 2C | CYN CLOSE WAIT | | wait for 30 seconds.<br>go to CYN CLOSE CHECK [step 4C]. | |
| 3C | CYN OPEN WAIT | | wait for 30 seconds.<br>go to CYN OPEN CHECK [step 5C]. | |
| 4C | CYN CLOSE CHECK | if open switch is on or close switch is off. | show error message. | horn is on.<br>red light is on. |
| | | if fault is reset. | go to POWER UP [step 1C]. | |
| 5C | CYN OPEN CHECK | if open switch is off or close switch is on. | show error message. | horn is on.<br>red light is on. |
| | | if fault is reset. | go to POWER UP [step 1C]. | |

Third, a controller temperature check function to detect abnormal furnace temperature is given in TABLE 13.

TABLE 13

| CONTROLLER TEMPERATURE CHECK | | | | |
|---|---|---|---|---|
| 1D | POWER UP | | set high high limit = T,cycle + 20° C.<br>set high limit = T,cycle + 10° C.<br>set low low limit = T,cycle − 20° C.<br>set low limit = T,cycle − 10° C. | |
| | | if cycle timer is turned on. | go to LIMIT CHECK [step 2D]. | |
| 2D | LIMIT CHECK | if controller temp > high high limit. | go to TEMP HIGH ERROR [step 3D]. | |
| | | if controller temp < low low limit. | go to TEMP LOW ERROR [step 4D]. | |
| | | if high high limit > controller temp > high limit. | go to TEMP HIGH LIMIT [step 5D]. | |
| | | if low low limit < controller temp < low limit. | go to TEMP LOW LIMIT [step 6D]. | |
| 3D | TEMP HIGH | | set Cycle_stop = 1. | horn is on. |

TABLE 13-continued

| CONTROLLER TEMPERATURE CHECK | | | | |
|---|---|---|---|---|
| | ERROR | | abort cycle. | red light is on. |
| 4D | TEMP LOW | | set Cycle_stop = 1. | horn is on. |
| | ERROR | | abort cycle. | red light is on. |
| 5D | TEMP HIGH | | activate warning. | horn is on. |
| | LIMIT | | | red light is on. |
| 6D | TEMP LOW LIMIT | | activate warning. | horn is on. |
| | | | | red light is on. |

Fourth, top temperature sensing using a thermocouple is given in TABLE 14.

TABLE 14

| TOP TEMPERATURE CHECK | | | | |
|---|---|---|---|---|
| 1E | POWER UP | | set high high limit = T,cycle + 15° C. | |
| | | | set high limit = T,cycle + 10° C. | |
| | | | set low low limit = T,cycle − 15° C. | |
| | | | set low limit = T,cycle − 10° C. | |
| | | if cycle timer ≧1 hour. | go to LIMIT CHECK [step 2E]. | |
| 2E | LIMIT CHECK | if controller temp > high high limit. | go to TEMP HIGH ERROR [step 3E]. | |
| | | if controller temp < low low limit. | go to TEMP LOW ERROR [step 4E]. | |
| | | if high high limit > controller temp > high limit. | go to TEMP HIGH LIMIT [step 5E]. | |
| | | if low low limit < controller temp < low limit. | go to TEMP LOW LIMIT [step 6E]. | |
| 3E | TEMP HIGH | | set Cycle_stop = 1. | horn is on. |
| | ERROR | | abort cycle. | red light is on. |
| 4E | TEMP LOW | | set Cycle_stop = 1. | horn is on. |
| | ERROR | | abort cycle. | red light is on. |
| 5E | TEMP HIGH | | activate warning. | horn is on. |
| | LIMIT | | | red light is on. |
| 6E | TEMP LOW LIMIT | | activate warning. | horn is on. |
| | | | | red light is on. |

Fifth, bottom temperature sensing using a thermocouple is given in TABLE 15.

TABLE 15

| BOTTOM TEMPERATURE CHECK | | | |
|---|---|---|---|
| 1F | POWER UP | | set high high limit = T,cycle + 15° C. |
| | | | set high limit = T,cycle + 10° C. |
| | | | set low low limit = T,cycle − 15° C. |
| | | | set low limit = T,cycle − 10° C. |
| | | if cycle timer ≧ 1 hour. | go to LIMIT CHECK [step 2F]. |
| 2F | LIMIT CHECK | if controller temp > high high limit. | go to TEMP HIGH ERROR [step 3F]. |
| | | if controller temp < low low limit. | go to TEMP LOW ERROR [step 4F]. |
| | | if high high limit > controller temp > high limit. | go to TEMP HIGH LIMIT [step 5F]. |
| | | if low low limit < | go to TEMP LOW LIMIT |

TABLE 15-continued

| BOTTOM TEMPERATURE CHECK | | | | |
|---|---|---|---|---|
| | | controller temp < low limit. | [step 6F]. | |
| 3F | TEMP HIGH ERROR | | set Cycle_stop = 1. abort cycle. | |
| 4F | TEMP LOW ERROR | | set Cycle_stop = 1. abort cycle. | |
| 5F | TEMP HIGH LIMIT | | activate warning. | horn is on. red light is on. |
| 6F | TEMP LOW LIMIT | | activate warning. | horn is on. red light is on. |

In the illustrative embodiment, interface with the user is provided through a number of display screens. This form of graphical operator interface is shown on a computer display 14 which can optionally be printed on printer 12. For all display modes, a menu toolbar is available with selectable functions of STATUS, AUTO, CONTROL, METERS, TRENDS, STATISTICAL PROCESS CONTROL (SPC), MANUAL, RECIPES, and ALARMS.

Figure 5:
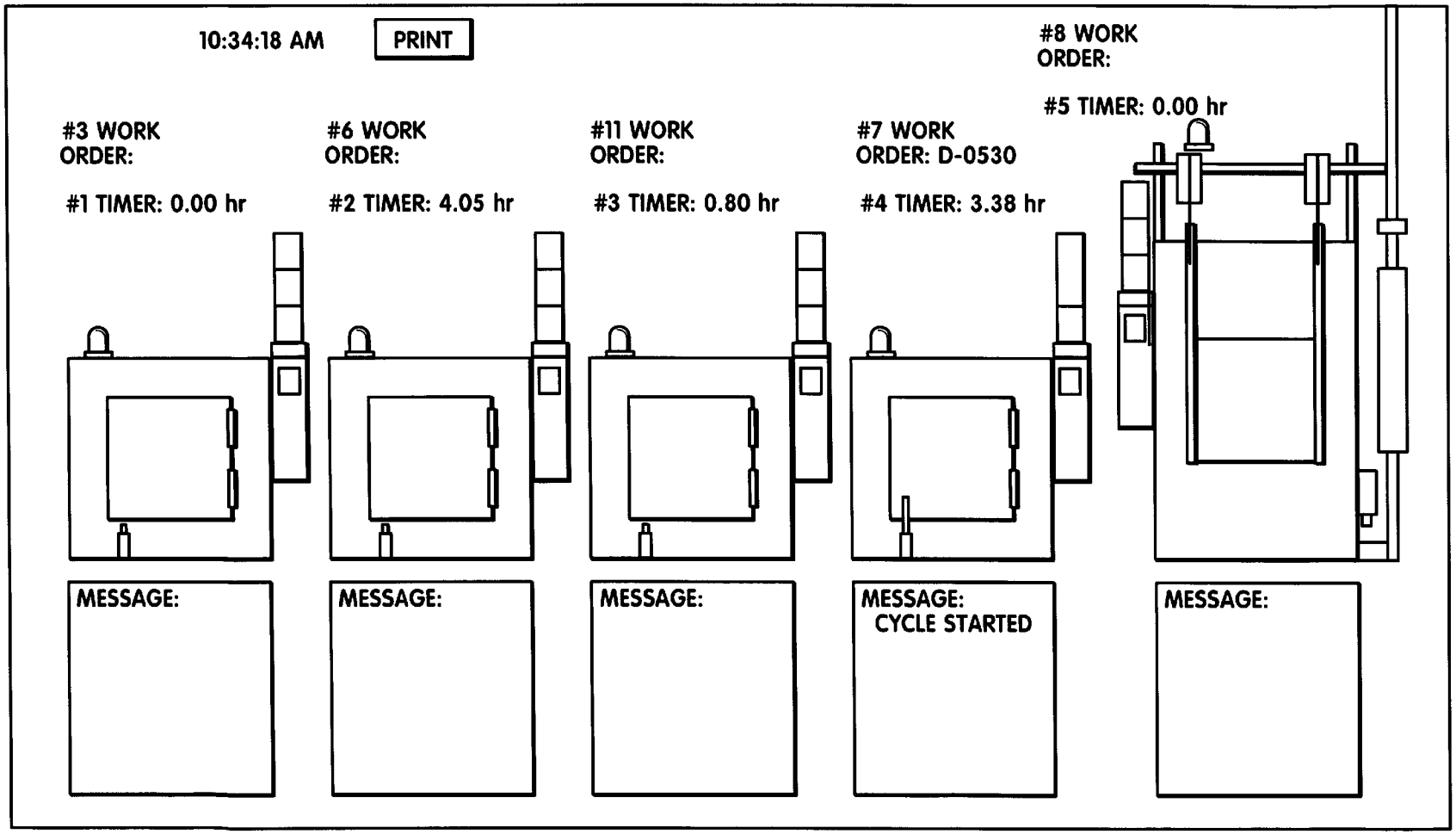
FIG. 5 is the graphical operator interface presentation of the illustrative embodiment of FIG. 3 consistent with the invention, including current settings and status information.

Activating the STATUS function from the menu toolbar brings up a status screen of the automation system, such as illustrated by FIG. 5. The information displayed includes animations of signal light 36 activation, signal horn 38 activation, oven door 35 position, and pneumatic cylinder 32 activation. Messages that require operator's attention are displayed. These messages include "Cycle Ready", "Cycle Started", "Wait for Temperature", "Open Door", "Close Door", "Load Material", "Unload Material", "Timer is On" and "Cycle Done". Work order number and elapsed time in hours are also displayed.

Selecting AUTO function from the menu toolbar causes an Auto screen to be displayed of current automatic cycle information of the furnace or furnaces including work order number, lot number, operator name, material, heat treatment process, deformation process, target configuration, reference document number, cycle temperature, cycle time, number of work pieces, and number of dummy pieces. A pushbutton labeled setup allows setup for each furnace displayed.

Selecting the CONTROL function from the menu toolbar causes a Control screen to be displayed with a Start and Stop button for the auto cycle for each furnace. An emergency abort button is also provided to stop all furnaces.

Selecting the METERS function from the menu toolbar causes a Meters screen to be displayed with digital readings of temperatures of top thermocouple, bottom thermocouple, controller thermocouple, and setpoint temperature. Digital clocks of elapsed cycle time in minutes is also shown.

Figure 6:
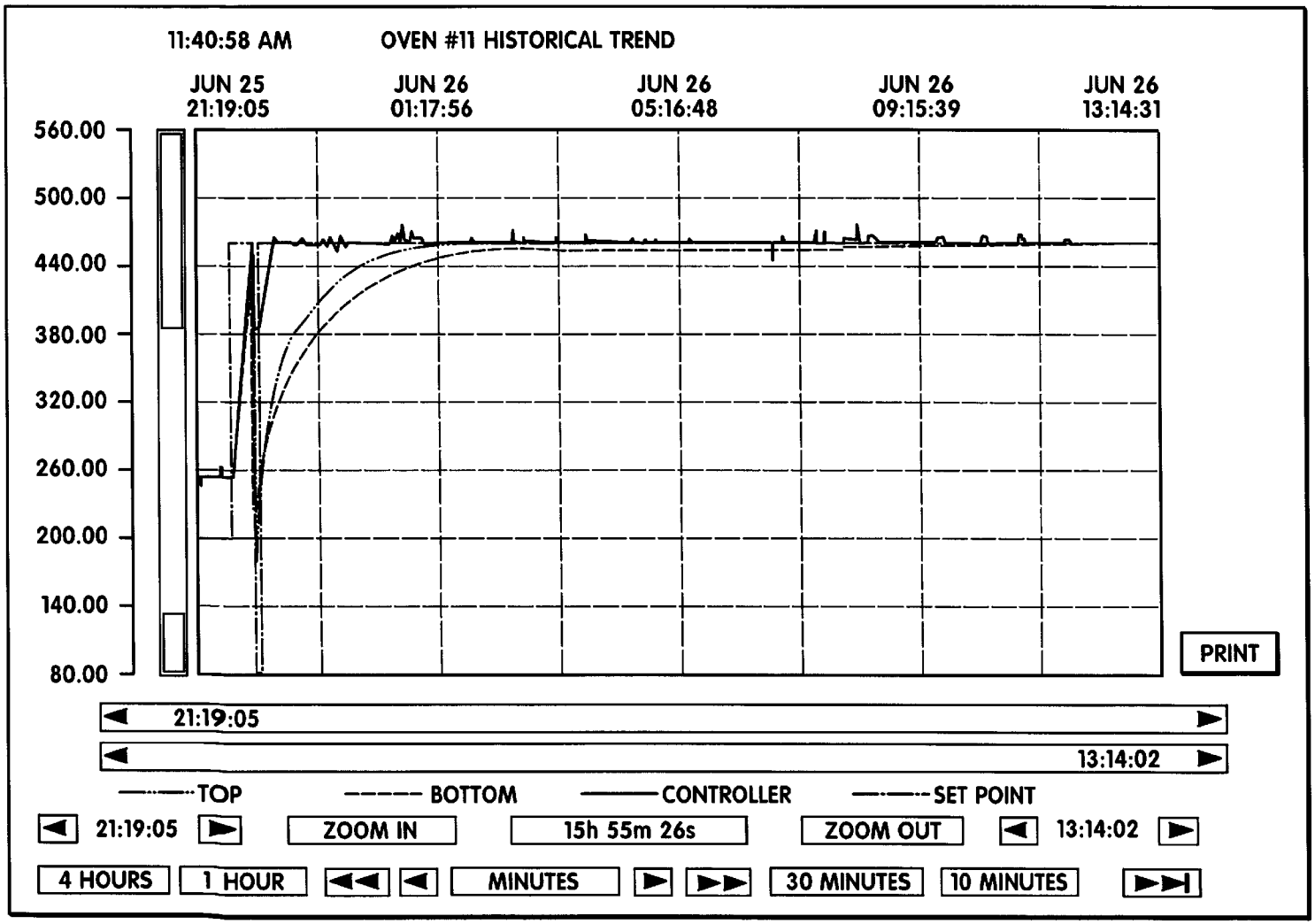
FIG. 6 is a depiction of historical process trend data from the illustrative embodiment of FIG. 3, derived from stored current temperature and graphically presented by the graphical operator interface.

Selecting the TRENDS function from the menu toolbar causes a Trends Selection screen to be displayed to select either real-time or historical trend for each furnace. Choosing Real-Time Trends will display a screen showing current readings of setpoint temperature, controller temperature, top temperature, and bottom temperature in thirty-minute interviews. Choosing Historical Trends will display a screen showing temperature readings of setpoint, control thermocouple, bottom thermocouple, and top thermocouple at any time interval in the past. See FIG. 6. It is well known in the art to calculate and display historical trend data.

Selecting STATISTICAL PROCESS CONTROL (SPC) function from the menu toolbar causes an SPC screen to be displayed showing current SPC readings recorded during homogenization and recrystallization cycles for each furnace. A statistical process control program analyzes a stored current furnace temperature. The graphical operator interface presents the result from the statistical process control program.

Selecting MANUAL function from the menu toolbar causes a Manual screen to be displayed, which has a precursor security entry screen for accepting operator code and security password. This screen provides manual controls of pneumatic cylinders 32, horns 38, and signal lights 36 in either steady or flashing mode. Oven setpoints can be entered by typing in the setpoint temperatures.

Selecting RECIPE function on the menu toolbar causes a Recipes Setup screen to be displayed, which can have a precursor security entry screen for accepting operator code and security password. This screen allows entering or modifying a heat treatment recipe. Required information for creating a recipe includes material composition, cycle temperature, cycle time, heat treatment process, target configuration, deformation process, and reference document number. Recipe name consists of material composition, heat treatment process, target configuration, deformation process, and reference document number.

Selecting ALARMS function from the menu toolbar causes the Alarm screen to be displayed showing alarms, events and alarm acknowledgments. A selectable pushbutton acknowledges new alarms.

It is to be understood that innumerable ways exist to present this information or similar information to the operator, and to accept control selections, including implementing menus. Substitutions exist such as discrete analog gauges and lights and mechanical switches and controls. In addition, the choice of menus and screen information could be configured differently.

The present invention as described above has a number of advantages over the manual system as should be apparent from the accompanying drawings and the description thereof.

First, precise controls of cycle temperature and heat treatment and heat treatment time are provided.

Second, cycle time and temperature are stored and retrieved as recipes from the graphical operator interface helping to minimize the likelihood of human error.

Third, the portions of the process that were not automated, specifically the loading and unloading of material from the furnace, is rendered more consistent by providing graphical process representations, audio alarms and visual alarms.

Fourth, the heat treatment apparatus and method includes a timely abort if cycle parameters are unacceptably violated, avoiding the possible recognition delays inherent with a human operator.

Fifth, the apparatus and method facilitates the capturing and presentation of historical data from which improvements to the system can be made using approaches such as statistical process control.

Sixth, the apparatus and method allow for system security to avoid unauthorized tampering with recipe parameters or dangerous or wasteful use of the furnace.

Seventh, the apparatus and method allow for reduced operator staffing and training requirements by reducing the amount of required human monitoring.

Eighth, the apparatus and method allow for the independent monitoring and control of multiple furnaces.

All of these features combine to reduce the variations in the process and thus to reduce the amount of defective material.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An automated heat treatment device for consistent heat treating of metallic targets comprising:

a furnace for heat treating the metallic targets according to a heat treatment recipe, the heat treatment recipe including a cycle temperature and a cycle exposure time, a programmed logic heat treatment controller including an oven controller for controlling a heat source within the furnace; a temperature controller for providing a temperature setpoint for the heat source; and a timer for measuring the cycle exposure time, the heat treatment controller configured for storing a current furnace temperature, for maintaining the cycle temperature in the furnace during the heat treatment, and for managing a cycle exposure time during heat treatment, a statistical process control program for evaluating the current furnace temperature, and a display screen connected to the heat treatment controller for presenting results of the statistical process control program and for prompting an operator for removing the metallic targets after the cycle exposure time has elapsed for the heat treatment recipe.

2. The automated heat treatment controller of claim 1 wherein the furnace has a remotely actuated door lock and the automated heat treatment controller is further configured to command actuation of the door lock during heat treatment to prevent inadvertent removal of the target being heat treated.

3. The heat treatment controller of claim 1 wherein the programmable logic controller further comprises a state logic processor that directly controls the programmable logic controller and executes a heat treatment program.

4. The automated heat treatment controller of claim 3 wherein the furnace further includes a remotely controllable door lock, the heat treatment controller further includes a door control interface for controlling the remotely controllable door lock, the state logic controller is further operably coupled to the furnace via the door control interface.

5. A method of heat treating a metallic target comprising:

a) accessing a heat treatment recipe, the heat treatment recipe having a cycle temperature and a cycle exposure time, b) introducing the metallic target into a furnace, the furnace having a programmed logic heat treatment controller, the heat treatment controller having an oven controller to control a heat source within the furnace, a temperature controller to provide a temperature setpoint for the heat source and a timer for measuring the cycle exposure time, c) storing a current furnace temperature in the heat treatment controller, d) evaluating the current furnace temperature with a statistical process control program, and e) displaying results from the statistical process control program on a display screen and prompting an operator to remove the metallic target after the cycle time has elapsed for the heat treatment recipe.

6. The method of claim 5 wherein prompting the operator to load and to unload further comprises:

activating a signal light;

activating a signal horn; and providing an alarm on the graphical operator interface.

7. The method of claim 5 further comprising continuously monitoring for one of a class of conditions warranting aborting a heat treatment, the class including detecting a malfunction; receiving an abort command from the operator; and inability to maintain cycle temperature approximately.

* * * * *